US011490488B2

(12) United States Patent
Lee et al.

(10) Patent No.: US 11,490,488 B2
(45) Date of Patent: Nov. 1, 2022

(54) SWITCHING DRIVING CIRCUIT AND DRIVING METHOD OF SWITCHING DRIVING CIRCUIT

(71) Applicant: MagnaChip Semiconductor, Ltd., Cheongju-si (KR)

(72) Inventors: Jang Hyuck Lee, Seongnam-si (KR); Joo Han Yoon, Seongnam-si (KR); Byoung Kwon An, Seoul (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 0 days.

(21) Appl. No.: 16/848,904

(22) Filed: Apr. 15, 2020

(65) Prior Publication Data

US 2021/0051785 A1 Feb. 18, 2021

(30) Foreign Application Priority Data

Aug. 13, 2019 (KR) ..... 10-2019-0098678

(51) Int. Cl.
*H05B 47/10* (2020.01)

(52) U.S. Cl.
CPC ..... *H05B 47/10* (2020.01)

(58) Field of Classification Search
CPC .... H05B 47/10; H05B 45/14; H05B 45/3725; H05B 47/14; H02M 1/08; H02M 3/156; H02M 1/0025; G01R 15/04; G01R 19/165
See application file for complete search history.

(56) References Cited

U.S. PATENT DOCUMENTS

| | | | | |
|---|---|---|---|---|
| 8,508,150 | B2 * | 8/2013 | Kuo | H05B 45/37 315/291 |
| 9,402,287 | B2 * | 7/2016 | Sasaki | H05B 45/37 |
| 2012/0049825 | A1 * | 3/2012 | Chen | H02M 3/156 323/284 |
| 2016/0128148 | A1 * | 5/2016 | Sasaki | G02F 1/1336 315/186 |

* cited by examiner

*Primary Examiner* — Minh D A
(74) *Attorney, Agent, or Firm* — NSIP Law

(57) ABSTRACT

A switching driving circuit includes a switch configured to switch a current supplied to a target circuit, a sensing resistor connected to the switch, a controller configured to control the switch by comparing a sensing voltage applied to the sensing resistor with a reference voltage, and a compensation circuit configured to regulate the reference voltage based on an amount of variation of an input voltage input into the target circuit and an output voltage output from the target circuit.

27 Claims, 9 Drawing Sheets

SWITCHING DRIVING CIRCUIT AND DRIVING METHOD OF SWITCHING DRIVING CIRCUIT

CROSS REFERENCE TO RELATED APPLICATIONS

This application claims the benefit under 35 U.S.C. 119(a) of Korean Patent Application No. 10-2019-0098678 filed on Aug. 13, 2019 in the Korean Intellectual Property Office, the entire disclosure of which is incorporated herein by reference for all purposes.

BACKGROUND

1. Field

The following description relates to a switching driving circuit. The following description also relates to a driving method of a switching driving circuit.

2. Description of Related Art

A switching driving circuit may be operated through a switching converter method. The type of switching converter may be classified according to the ratio of the input voltage to the output voltage, and may include a metal-oxide-semiconductor field effect transistor (MOSFET) to implement an average inductor current mode method.

A typical driving circuit including a MOSFET may full-wave rectify AC power, may sense a full-wave rectified voltage magnitude, and may selectively applies a full-wave rectified voltage to a target circuit such as a display according to the sensed voltage magnitude.

In this example, the sensed voltage magnitude may vary along with an input voltage applied to a target circuit, such as a display or an output voltage output through the target circuit. Due to such variation, there may be an issue in which the desired full-wave rectified voltage may not be able to be applied to the target circuit, and due to this issue, the typical switching driving circuit may not be able to drive the driving current for driving the target circuit with a desired brightness.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a switching driving circuit include a switch configured to switch a current supplied to a target circuit, a sensing resistor connected to the switch, a controller configured to control the switch by comparing a sensing voltage applied to the sensing resistor with a reference voltage, and a compensation circuit configured to regulate the reference voltage based on an amount of variation of an input voltage input into the target circuit and an output voltage output from the target circuit.

The controller may turn off the switch, in response to the sensing voltage and the reference voltage being substantially identical to each other.

The compensation circuit may be configured to regulate the reference voltage to have a low value based on the increase amount of the input voltage, in response to the input voltage and the output voltage increasing simultaneously, and the compensation circuit may be configured to regulate the reference voltage to have a high value based on the decrease amount of the input voltage, in response to the input voltage and the output voltage decreasing simultaneously.

The compensation circuit may be configured to regulate the reference voltage to have a low value based on the increase amount of the output voltage, in response to the input voltage being constant and the output voltage increasing, and the compensation circuit may be configured to regulate the reference voltage to have a high value based on the decrease amount of the output voltage, in response to the input voltage being constant and the output voltage decreasing.

The compensation circuit may include a first conversion block configured to convert a level of the input voltage, and a second conversion block configured to convert a level of the output voltage.

The switching driving circuit may further include a voltage divider connected to the switch and the controller, configured to apply a divided voltage to the controller.

The voltage divider may include resistors configured to divide voltage, and a capacitor connected in series with the resistors.

The compensation circuit may include a first conversion block configured to convert a level of the input voltage, and the output voltage may be the divided voltage.

The compensation circuit may be configured to regulate the reference voltage to have a low value based on an increase amount of the input voltage, in response to the input voltage and the divided voltage increasing simultaneously, and the compensation circuit may be configured to regulate the reference voltage to have a high value based on a decrease amount of the input voltage, in response to the input voltage and the divided voltage decreasing simultaneously.

The compensation circuit may be configured to regulate the reference voltage to have a low value based on an amount of decrease of the divided voltage, in response to the input voltage being constant and the divided voltage decreasing, and the compensation circuit may be configured to regulate the reference voltage to have a high value based on an amount of increase of the divided voltage, in response to the input voltage being constant and the divided voltage increasing.

The controller may include an input terminal configured to check the input voltage, a voltage divider terminal configured to check the divided voltage, a switching terminal configured to check a switching control signal applied to the switch from the controller, a sensing terminal configured to check the sensing voltage, and a reference voltage terminal configured to check the reference voltage.

The controller may include at least one comparator configured to compare the sensing voltage and the reference voltage.

The controller may include an input terminal configured to check the input voltage, an output terminal configured to check the output voltage, a voltage divider terminal configured to check the divided voltage, a switching terminal configured to check a switching control signal applied to the switch from the controller, a sensing terminal configured to check the sensing voltage, and a reference voltage terminal configured to check the reference voltage.

The target circuit may include at least one light emitting device, and at least one inductor connected in series with the at least one light emitting device, wherein the switch is configured to switch a current in the at least one light emitting device.

In another general aspect, a driving method of a switch includes controlling the switch by comparing a sensing voltage applied to a sensing resistor connected to one end of the switch with a reference voltage, measuring an input voltage and an output voltage of a target circuit connected to the other end of the switch, and regulating the reference voltage according to a variation of the input voltage and a variation of the output voltage, wherein the switch is turned off in response to the sensing voltage and the reference voltage being substantially identical to each other.

The controlling may include comparing the sensing voltage and the reference voltage; and outputting a switching control signal for turning off the switch, by a controller, in response to the sensing voltage and the reference voltage being substantially identical to each other.

The regulating of the reference voltage may regulate the reference voltage to have a low value based on an increase amount of the input voltage, in response to the input voltage and the output voltage increasing simultaneously.

The regulating of the reference voltage may regulate the reference voltage to have a high value based on a decrease amount of the input voltage, in response to the input voltage and the output voltage decreasing simultaneously.

The regulating of the reference voltage may regulate the reference voltage to have a low value based on an increase amount of the output voltage, in response to the input voltage being constant and the output voltage increasing.

The regulating of the reference voltage may regulate the reference voltage to have a high value based on a decrease amount of the output voltage, in response to the input voltage being constant and the output voltage decreasing.

The measuring of the output voltage may measure a divided voltage generated by a voltage divider including resistors and capacitors connected in parallel with the switch.

The regulating of the reference voltage may regulate the reference voltage to have a low value based on an increase amount of the input voltage, in response to the input voltage and the divided voltage simultaneously increasing, and the regulating of the reference voltage may regulate the reference voltage to have a high value based on a decrease amount of the input voltage, in response to the input voltage and the divided voltage decreasing simultaneously.

The regulating of the reference voltage may regulate the reference voltage to have a low value based on a decrease amount of the divided voltage, in response to the input voltage being constant and the divided voltage decreasing, and the regulating of the reference voltage may regulate the reference voltage to have a high value based on an increase amount of the divided voltage, in response to the input voltage being constant and the divided voltage increasing.

In another general aspect, a switching driving circuit includes a switch configured to switch a current supplied to a target circuit, a sensing resistor connected to the switch, a controller configured to control the switch by comparing a sensing voltage applied to the sensing resistor with a reference voltage, and a compensation circuit configured to regulate the reference voltage based on either one or both of an input voltage input into the target circuit and an output voltage output from the target circuit.

The controller may turn off the switch in response to the sensing voltage and the reference voltage being substantially identical to each other.

The compensation circuit may comprise either one or both of a first conversion block configured to convert a level of the input voltage and a second conversion block configured to convert a level of the output voltage.

The switching driving circuit may further include a voltage divider connected to the switch and the controller, configured to apply a divided voltage to the controller.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
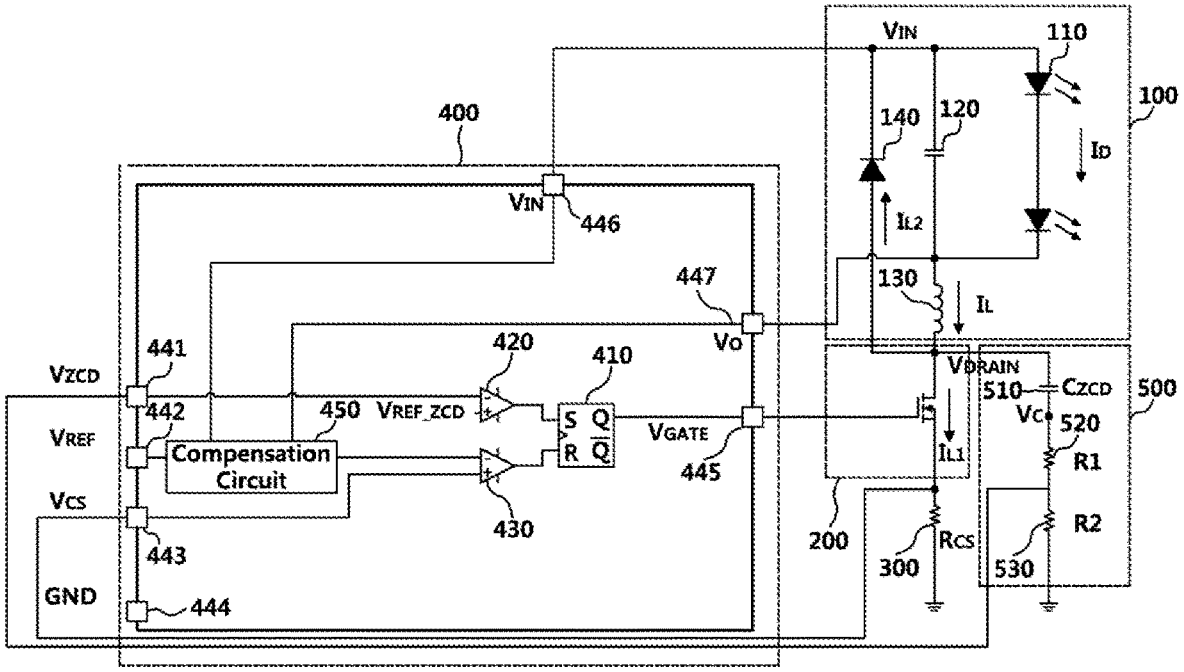
FIG. 1 is a view illustrating a switching driving circuit according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include varies in shape that occur during manufacturing.

Herein, it is noted that use of the term "may" with respect to an example or embodiment, e.g., as to what an example or embodiment may include or implement, means that at least one example or embodiment exists where such a feature is included or implemented while all examples and embodiments are not limited thereto.

The features of the examples described herein may be combined in various ways, as will be apparent after an understanding of the disclosure of this application. Further, although the examples described herein have a variety of configurations, other configurations are possible, as will be apparent after an understanding of the disclosure of this application.

The following examples may provide a driving circuit that maintains the driving current $I_D$ used for driving the circuit to be constant even if the input voltage $V_{IN}$ or output voltage $V_O$ varies, and a driving method of such a driving circuit.

FIG. 1 illustrates a switching driving circuit according to an example.

According to the example of FIG. 1, the switching driving circuit may include a switch 200, a sensing resistor 300, a controller 400, and a voltage divider 500, as a non-limiting example. However, the switching driving circuit is not limited to these example elements, and may include additional elements in addition to or instead of these elements, in other examples.

The switch 200 may be an element used for switching a current supplied to a target circuit 100.

The target circuit 100 may be a circuit including a device which emits light when a current is supplied, but may not be limited to such a circuit. The target circuit 100 may refer to a circuit including all devices that perform a certain function when a current is supplied to the device.

When the target circuit 100 is a circuit including a device that emits light when a current is supplied, at least one light emitting device 110, at least one capacitor 120 connected in parallel with the light emitting device 110, at least one diode 140 for rectifying the current input to the light emitting device 110 and the capacitor 120, and at least one inductor 130 connected in series to the light emitting device 110 and the capacitor 120, connected in parallel with the light emitting device 110, may be included.

The switch 200 may be disposed between the inductor 130 and the controller 400, and may control the inductor current $I_L$ in the inductor 130 by receiving a switching control signal from the controller 400.

When the switch 200 is turned on, the inductor current $I_{L1}$ or driving current $I_D$ may flow according to the input voltage $V_{IN}$. When the switch 200 is turned off, the current $I_{L2}$ charged in the inductor 130 may be discharged to supply driving current $I_D$ into the light emitting device.

When the switching control signal corresponds to a positive value, such as a high level or 1, the switch 200 may be turned on, and if the switching control signal corresponds to a negative value, such as a low level or 0, the switch 200 may be turned off. In this way, the controller 400 may regulate the inductor current $I_L$ or the driving current $I_D$ supplied to the target circuit 100. In particular, when the target circuit 100 includes the light emitting device 110, the brightness of the light emitting device 110 may be regulated.

When the switch 200 is turned on, the inductor current $I_{L1}$ may flow through the switch 200, and the inductor 130 may charge the inductor current $I_{L1}$. When the switch 200 is turned off, the current charged in the inductor 130 may be supplied as the discharge current $I_{L2}$ in order to supply the current into the light emitting device 110. That is, while the switch 200 is turned off, the inductor discharge current $I_{L2}$ may operate as a current source of the inductor 130.

The sensing resistor 300 may be connected to the switch 200, and may also be electrically connected to the switch 200 and the controller 400. The sensing voltage $V_{CS}$ applied to opposite ends of the sensing resistor 300 may be applied to the controller 400 through the sensing terminal 443.

When the inductor current $I_L$ reaches a value of zero, the controller 400 may provide a switching control signal used for turning on the switch 200. More specifically, when the inductor current $I_L$ falls below a value of zero, the drain terminal of the switch 200 MOSFET may have a negative value, such as a low level or 0, and the divided voltage $V_{ZCD}$ may reach a lower negative value, such as a low level or 0, than the reference divided voltage $V_{REF_ZCD}$ in order to turn on the switch 200.

The sensing voltage $V_{CS}$ may refer to a voltage applied to opposite ends of the sensing resistor 300, and the sensing voltage $V_{CS}$ may be applied to the controller 400 through the sensing terminal 443. The input voltage $V_{IN}$ may refer to a voltage input to the target circuit 100 and may be applied to the controller 400 through the input terminal 446. The output voltage $V_O$ may be a voltage output from the target circuit 100 and may be applied to the controller 400 through the output terminal 447. In addition, the sensing voltage $V_{CS}$, the input voltage $V_{IN}$, and the output voltage $V_O$ may be checked from the outside through using the terminals.

The controller 400 may control the switch 200 by comparing the sensing voltage $V_{CS}$ applied to the sensing resistor 300 with a preset reference voltage $V_{REF}$.

The reference voltage $V_{REF}$ may have a preset value, and the controller 400 may regulate a set value of the reference voltage $V_{REF}$. By regulating the set value of the reference voltage $V_{REF}$, the inductor current $I_L$ or the driving current $I_D$ may be constant even when the sensing voltage $V_{CS}$ varies, according to the amount of variation of the input voltage $V_{IN}$ or the output voltage $V_O$. In addition, the reference voltage $V_{REF}$ may be checked from the outside through using the reference voltage terminal 442.

The controller 400 may regulate a set value of the reference voltage $V_{REF}$, and may include comparators 420 and 430 and a memory device 410. A gate driver may be further included, of which one end may be connected to the memory device 410 and the other end may be connected to the switch 200. The gate driver may amplifies the output of the memory device 410 to produce a voltage required for turning on or off of the switch 200, and may output a switching control signal at a low impedance. The gate driver may quickly provide a switching control signal into the switch 200, based on the variation in the output value of the memory device 410. For example, the memory device 410 may be implemented as an SR latch.

In addition, the controller 400 may include an input terminal 446, an output terminal 447, a reference voltage terminal 442, a ground terminal 444, a voltage divider terminal 441, and a switching terminal 445, as a non-limiting example. The input voltage $V_{IN}$ input to the target circuit 100 through the input terminal 446 may be checked to ensure that it has an appropriate value. The output voltage $V_O$ output from the target circuit 100 through the output terminal 447 may checked, similarly. The controller 400 may be grounded through the ground terminal 444. The divided voltage $V_{ZCD}$ may be checked through the voltage divider terminal 441, as with the other voltages. The controller 400 may transmit a switching control signal to the switch 200 through the switching terminal 445.

The switching driving circuit according to an example may further include a voltage divider 500.

The voltage divider 500 may be connected to the switch 200 and the controller 400, and may regulate the divided voltage $V_{ZCD}$ applied from the switch 200 to the controller 400. In addition, the voltage divider 500 may be connected to the target circuit 100.

The voltage divider 500 may divide the output voltage $V_O$ output from the target circuit 100 by a desired voltage magnitude. To accomplish such an end, the voltage divider 500 may include at least one resistor and at least one capacitor. For example, a first divider resistor 520, a second divider resistor 530, and the capacitor 510 may be included in the voltage divider 500, and the first divider resistor 520, the second divider resistor 530 and the capacitor 510 may be connected in series. In this example, each of the first and second divider resistors 520 and 530 may not be restricted to being one resistor, and the number may not be limited, in other examples.

The capacitor 510 may be electrically connected to the inductor 130 and the switch 200. The capacitor 510 may cut off the DC component of the inductor current $I_{L1}$ and may pass the AC component. At this time, the capacitor voltage $V_C$ may be measured between the capacitor 510 and the first divider resistor 520.

The first and second divider resistors 520, 530 may divide the voltage of the AC component passing through the capacitor 510. Such a divided voltage may be applied to the controller 400, such as through the voltage divider terminal 441 of the controller 400.

The divided voltage produced through the voltage divider 500 may be regulated through a ratio of resistance values of the first and second divider resistors 520 and 530. For example, when the ratio of the resistance values of the first and second divider resistors 520 and 530 corresponds to a ratio of 9:1, the divided voltage $V_{ZCD}$ applied to the controller 400 may correspond to 1/10 of the AC component voltage that passes through the capacitor 510.

Because the controller 400 may be operated by using a voltage substantially lower than the input voltage $V_{IN}$ received from the input power source, the first and second divider resistors 520 and 530 may prevent an overload of the controller 400.

Figure 2:
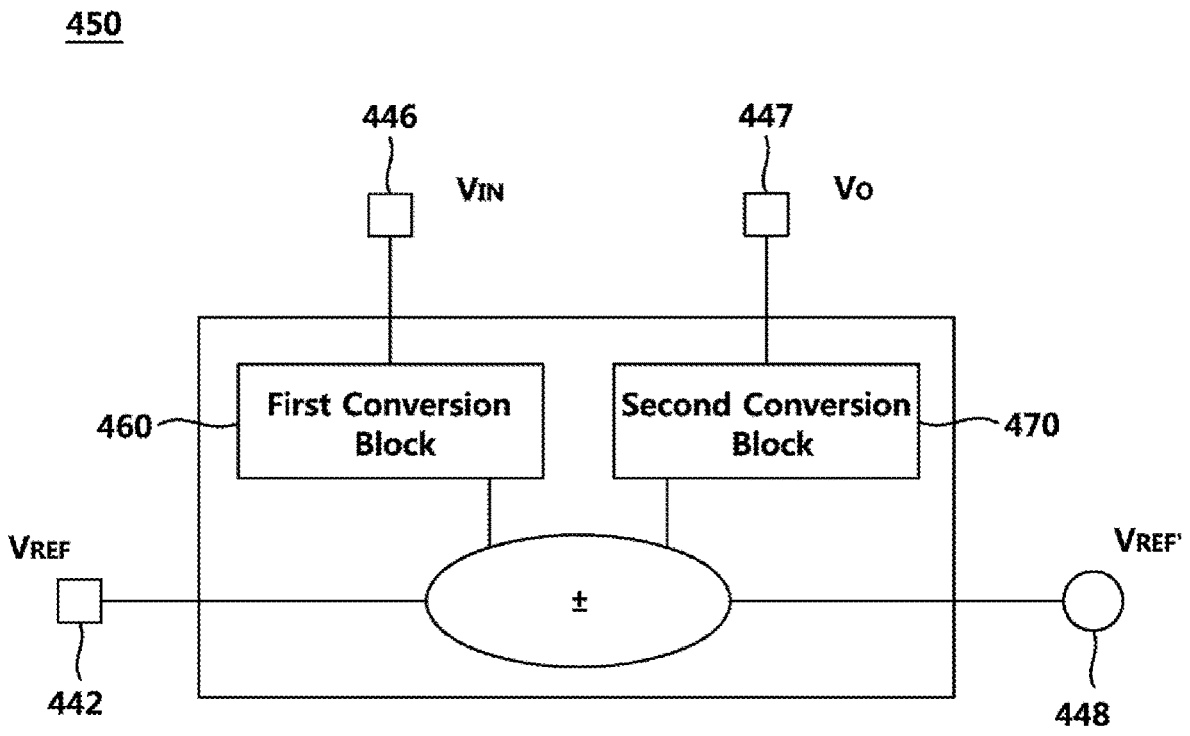
FIG. 2 illustrates a compensation circuit inside the switching driving circuit illustrated in the example of FIG. 1.

FIG. 2 illustrates a compensation circuit inside the switching driving circuit according to an example.

According to the example of FIG. 2, the compensation circuit 450 may receive the input voltage $V_{IN}$ and the output voltage $V_O$. The compensation circuit 450 may include a first conversion block 460 that converts the level of the input voltage $V_{IN}$ and a second conversion block 470 that converts the level of the output voltage $V_O$. The compensation circuit 450 may vary the set value of the reference voltage $V_{REF}$ to the modified reference voltage $V_{REF}$ according to the input voltage $V_{IN}$ and the output voltage $V_O$ sensed by the first and second conversion blocks 460 and 470.

The compensation circuit 450 may be configured inside the controller 400, but the positioning may not be limited to this example configuration, and other configurations may be possible in other examples. The compensation circuit 450 may share terminals of the controller 400, and the compensation circuit 450 may be connected to the second comparator 430 included in the controller 400.

Input voltage $V_{IN}$ and output voltage $V_O$ may be more than tens of volts, such that such voltages may not be safely used in the IC. Accordingly, a first conversion block 460 and a second conversion block 470 that regulate the magnitude of input voltage $V_{IN}$ and the magnitude of output voltage $V_O$ to a magnitude usable inside the IC may be required, as a separate element from the IC. The first conversion block 460 may regulate the magnitude of the input voltage $V_{IN}$ to a magnitude usable inside the IC. In addition, the second conversion block 470 may regulate the magnitude of the output voltage $V_O$ to a magnitude usable inside the IC.

The compensation circuit 450 may detect the amount of variation by regulating the input voltage $V_{IN}$ and the output voltage $V_O$ to an appropriate magnitude by using the first conversion block 460 and the second conversion block 470, may output the modified reference voltage $V_{REF}'$ based on the sensed amount of variation, and the modified reference voltage $V_{REF}'$ may be applied to the inversion terminal of the second comparator 430 through the modified reference voltage node 448. The compensation circuit 450 may efficiently sense the amount of variation in the input voltage $V_{IN}$ or the output voltage $V_O$ by sensing the amount of variation through the input voltage $V_{IN}$ or the output voltage $V_O$ of the regulated magnitude.

Figure 3:
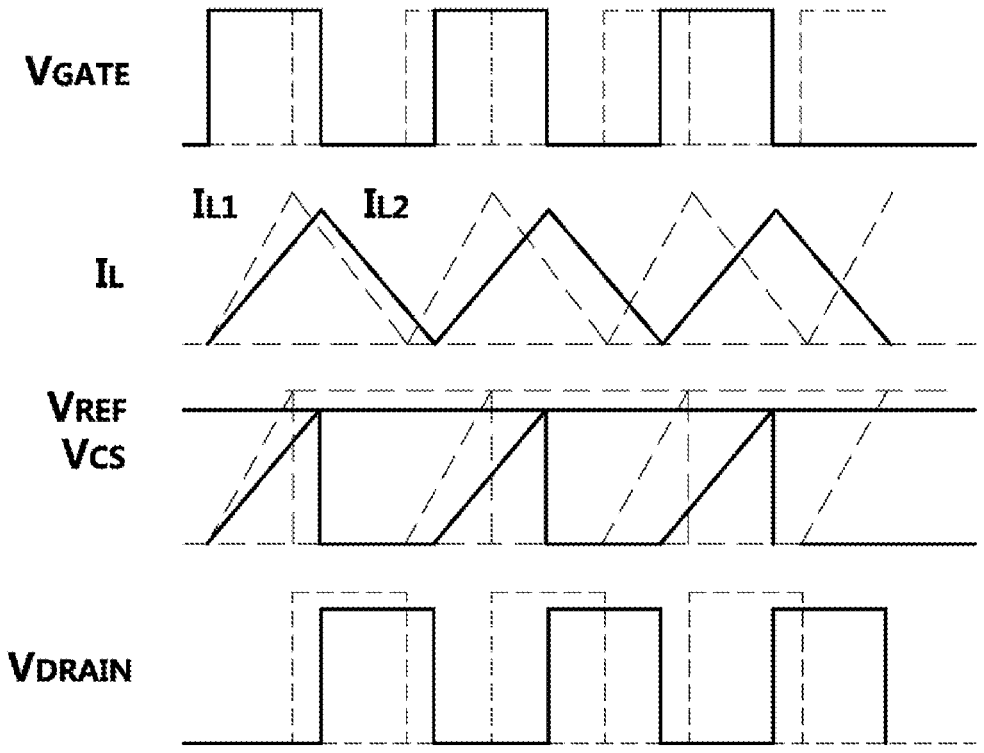
FIG. 3 is a timing diagram of a typical switching driving circuit without a compensation circuit.
Figure 4:
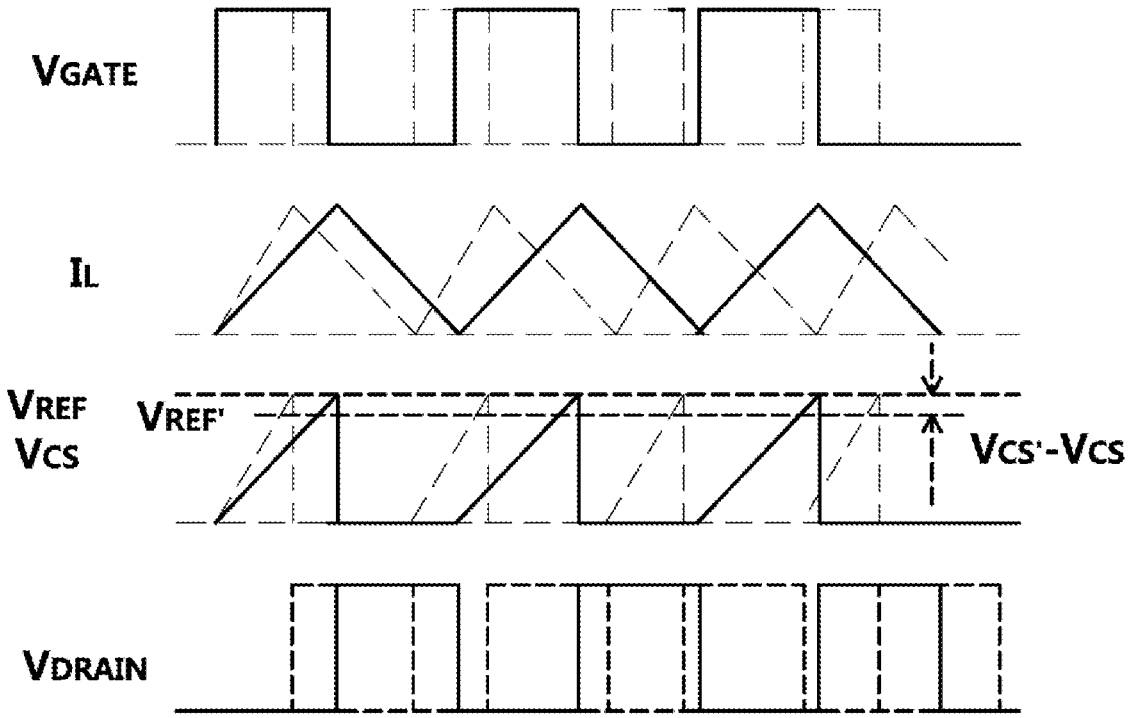
FIG. 4 is a timing diagram of a switching driving circuit according to an example.

FIG. 3 is a timing diagram of a conventional switching driving circuit without a compensation circuit. FIG. 4 is a timing diagram of a switching driving circuit according to an example.

The dotted lines in the examples of FIGS. 3 and 4 represent the example in which the input voltage $V_{IN}$ is increased, and the solid lines represent the example in which a constant input voltage is supplied.

With reference to the examples of FIGS. 3 and 4, the sensing voltage $V_{CS}$, serving as a reference voltage for supplying current to the target circuit 100, may be varied as an input voltage $V_{IN}$ applied to a target circuit 100 or an output voltage $V_O$ output from the target circuit 100 varies.

With reference to the examples of FIGS. 3 and 4, the controller 400 may turn off the switch 200 through using a switching control signal when the sensing voltage $V_{CS}$ and the reference voltage $V_{REF}$ are substantially identical to each other.

According to the example of FIG. 3, when the input voltage $V_{IN}$ is increased, the inductor current $I_L$ may increase, and the slope of the rising current $I_{L1}$ may increase. When the slope of the rising current $I_{L1}$ increases, the slope of the sensing voltage $V_{CS}$ may also increase. As a result, a significant excess part of reference voltage may occur, causing an increase of the driving current $I_D$ to be high. When the sensing voltage $V_{CS}$ and the reference voltage $V_{REF}$ are substantially identical to each other, the switch 200 may be turned off, which may be caused due to the delay time required.

In such an example, the rising current $I_{L1}$ may refer to a current in a section in which the inductor current $I_L$ rises when the switch 200 is turned on. The falling current $I_{L2}$ may refer to a current in a section in which the inductor current $I_L$ falls when the switch 200 is turned off.

By contrast, when the input voltage $V_{IN}$ is decreased, the inductor current $I_L$ decreases, and the slope of the rising current $I_{L1}$ also decreases. As the slope of the rising current $I_{L1}$ decreases, the sensing voltage $V_{CS}$ may also be instantaneously lower than the reference voltage $V_{REF}$. When the sensing voltage $V_{CS}$ is lower than the reference voltage $V_{REF}$, the driving current $I_D$ may also decrease, accordingly.

The variation in the sensing voltage $V_{CS}$ according to the variation in the input voltage $V_{IN}$ may also occur when the output voltage $V_O$ is increased or decreased. That is, a variation in the input voltage $V_{IN}$ or the output voltage $V_O$ may affect the sensing voltage $V_{CS}$, which may cause the variation of the driving current $I_D$. In particular, when the target circuit 100 includes a light emitting device 110, the light emitting device 110 may not be able to be operated at a desired brightness level.

In order to solve such a problem, as illustrated in the example of FIG. 3, the following examples propose a switching driving method, as illustrated in the example of FIG. 4. When the set value of the reference voltage $V_{REF}$ is varied by the amount of variation $V_{CS}'-V_{CS}$ of the sensing voltage $V_{CS}$, the variation of the driving current $I_D$ may be prevented.

Therefore, if the amount of variation in the sensing voltage $V_{CS}$ is able to be measured, the set value of the reference voltage $V_{REF}$ may be varied according to the amount of variation $V_{CS}'-V_{CS}$ of the sensing voltage $V_{CS}$, which may prevent the driving current $I_D$ from varying.

However, the variation in the input voltage $V_{IN}$ or the output voltage $V_O$ may affect the sensing voltage $V_{CS}$. Thus, it may be difficult to measure the amount of variation $V_{CS}'-V_{CS}$ of the sensing voltage $V_{CS}$ switched by the switch 200 accurately every minute. Therefore, it may be preferable to measure an amount of variation of the input voltage $V_{IN}$ and the output voltage $V_O$, which is relatively easily measurable, and then vary the set value of the reference voltage $V_{REF}$ based on the amount of such variation.

Specifically, if the reference voltage $V_{REF}$ is reduced by the increase amount of the sensing voltage $V_{CS}$ due to the increase in the input voltage $V_{IN}$ and the output voltage $V_O$, the driving current $I_D$ may be prevented from increasing. By contrast, when the reference voltage $V_{REF}$ is increased by the amount of decrease in the sensing voltage $V_{CS}$ due to the decrease in the input voltage $V_{IN}$ and the output voltage $V_O$, the driving current $I_D$ may be prevented from decreasing. Accordingly, the compensation circuit 450 may operate the light emitting device 110 at the desired brightness by controlling the driving current $I_D$ flowing in the light emitting device 110 appropriately.

Figure 5:
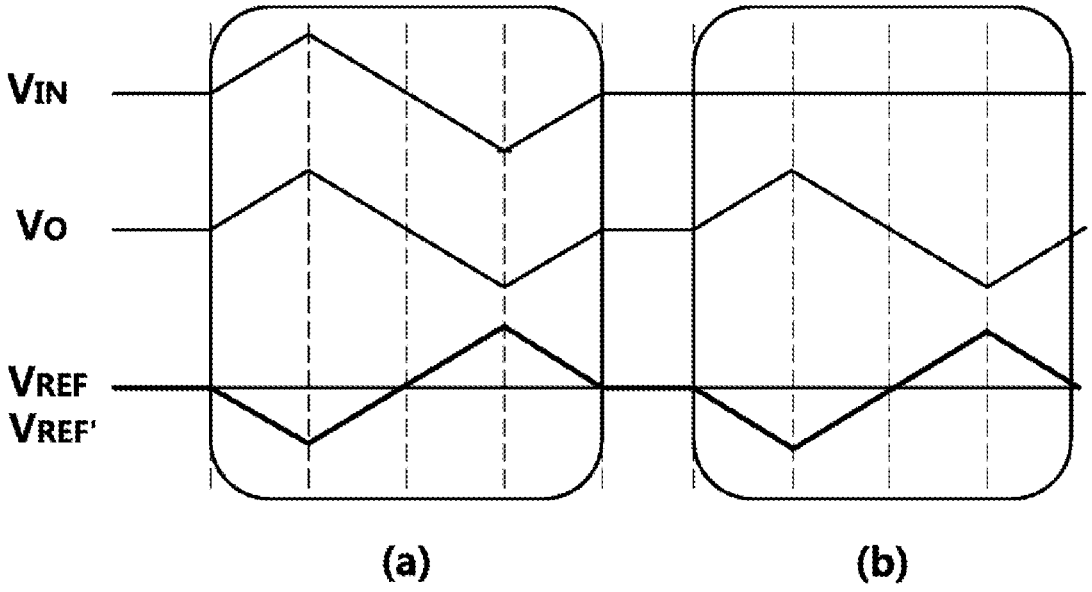
FIG. 5 illustrates a reference voltage regulated according to an input voltage or an output voltage variation applied to a compensation circuit according to an example.

FIG. 5 illustrates a reference voltage regulated according to the variation of an input voltage or an output voltage applied to the compensation circuit according to an example.

FIG. 5, at (a), illustrates a signal in which an input voltage $V_{IN}$ and an output voltage $V_O$ are simultaneously varied. In general, the output voltage $V_O$ may vary with the variation of the input voltage $V_{IN}$.

FIG. 5, at (b), illustrates a signal in which an input voltage $V_{IN}$ is kept constant, but an output voltage $V_O$ is varied by other factors. The other factors may include an example in which resistance values of devices are varied due to the dispersion of the semiconductor manufacturing process.

According to FIG. 5, at (a), the existing reference voltage $V_{REF}$ may be output as a modified reference voltage $V_{REF}'$, in a direction opposite to the variation of the input voltage $V_{IN}$. Because the output voltage $V_O$ may vary according to the input voltage $V_{IN}$, in this example, it may be preferable to output the modified reference voltage $V_{REF}'$ based on the input voltage $V_{IN}$, and not the output voltage $V_O$.

Specifically, when the input voltage $V_{IN}$ and the output voltage $V_O$ increase simultaneously, the reference voltage $V_{REF}$ may be regulated to have a low value, based on the increase amount of the input voltage $V_{IN}$. By contrast, when the input voltage $V_{IN}$ and the output voltage $V_O$ decrease simultaneously, the reference voltage $V_{REF}$ may be regulated to have a high value, based on the decrease amount of the input voltage $V_{IN}$.

According to FIG. 5, at (b), when the input voltage $V_{IN}$ is kept constant but the output voltage $V_O$ increases, the reference voltage $V_{REF}$ may be regulated to have a low value, based on the increase amount of the output voltage $V_O$. By contrast, when the input voltage $V_{IN}$ is kept constant but the output voltage $V_O$ decreases, the reference voltage $V_{REF}$ may be regulated to have a high value, based on the decrease amount of the output voltage $V_O$.

Subsequently, a switching driving apparatus according to another example is described in detail with reference to the accompanying drawings. For reference, the other example is described only in comparison with the above-described example and similar parts are omitted by referring to the above description.

Figure 6:
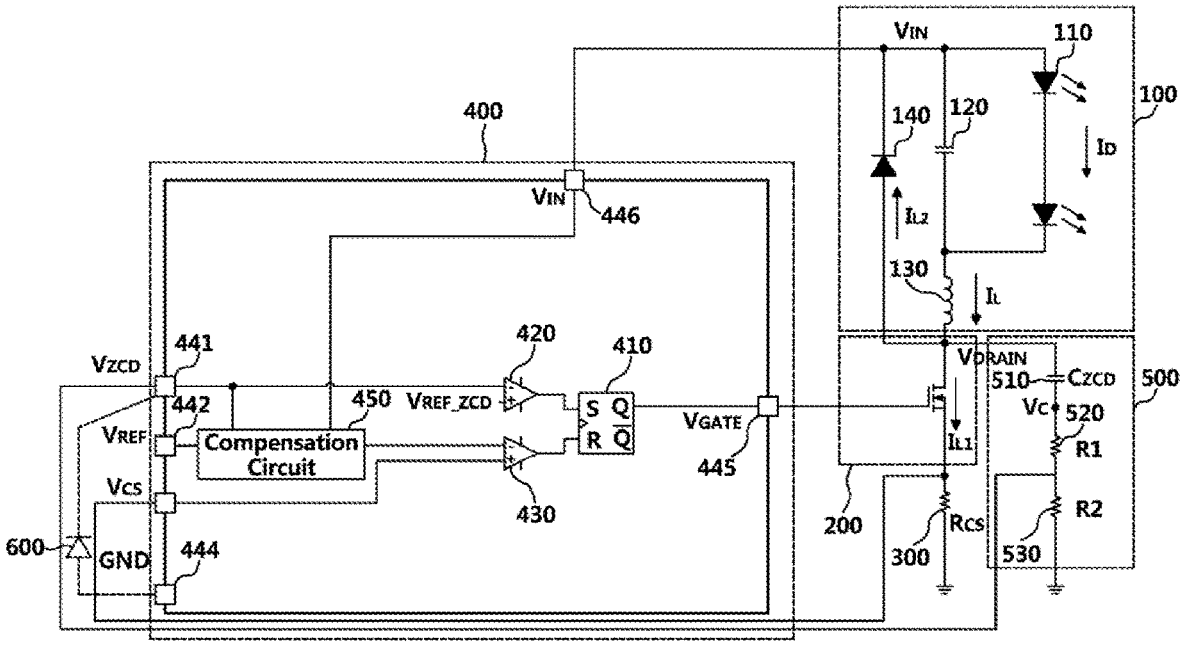
FIG. 6 illustrates a switching driving circuit according to an example.

FIG. 6 illustrates a switching driving circuit according to an example.

According to the example of FIG. 6, the switching driving circuit according to the example may include a switch 200, a sensing resistor 300, a controller 400, and a voltage divider 500, as a non-limiting example, and other elements may be present in addition to or instead of these elements.

The controller 400 of the switching driving circuit according to the example of FIG. 6 may include the input terminal 446, the reference voltage terminal 442, the ground terminal 444, the voltage divider terminal 441 and the switching terminal 445. According to the example of FIG. 6, unlike the example of FIG. 1, the controller 400 may not include the output terminal 447 separately. That is, the controller 400 may receive the divided voltage $V_{ZCD}$, and not the output voltage $V_O$, as an input of the compensation circuit. In this example, the divided voltage $V_{ZCD}$ divided by the voltage divider 500 may have a voltage value low enough to be applied to the controller 400.

Figure 7:
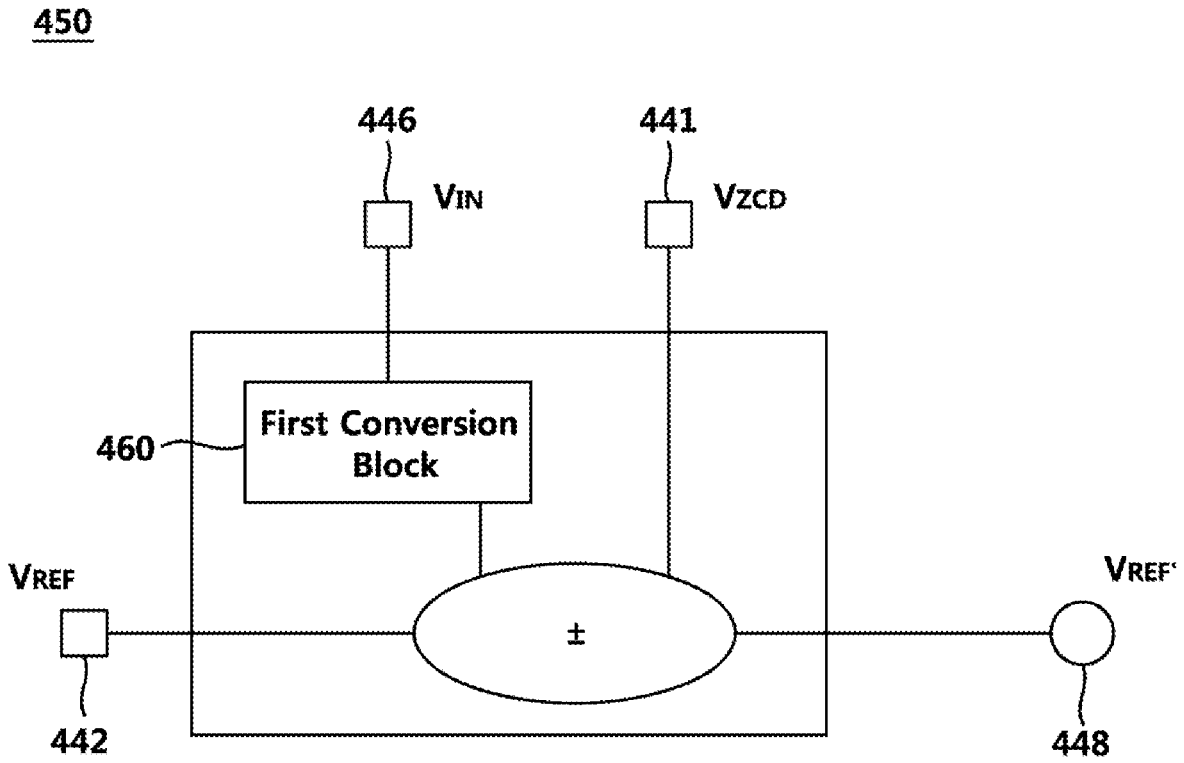
FIG. 7 illustrates a compensation circuit inside the switching driving circuit illustrated in the example of FIG. 6.

FIG. 7 illustrates a compensation circuit inside the switching driving circuit according to the example of FIG. 6.

According to the example of FIG. 7, the compensation circuit included in the controller 400 may be a compensation circuit 450 including an input terminal 446 that checks the input voltage $V_{IN}$. In this case, unlike the example of FIG. 2, the compensation circuit 450 may not include the output terminal 447 and the second conversion block 470, and the divided voltage $V_{ZCD}$ may be directly applied from the voltage divider terminal 441.

An input voltage $V_{IN}$ may have a magnitude of more than tens of volts, so that input voltage $V_{IN}$ may not be used in the IC. Accordingly, a first conversion block 460 that regulates the input voltage $V_{IN}$ to a magnitude usable inside the IC may be required to be present, separately. The first conversion block 460 may regulate the magnitude of the input voltage $V_{IN}$ to a magnitude usable inside the IC.

Thus, in such an example, when the input voltage $V_{IN}$ is regulated to an appropriate magnitude through using the first conversion block 460, the input voltage $V_{IN}$ may be applied to the compensation circuit 450 inside the controller 400 with the regulated magnitude. In this manner, the controller 400 may efficiently sense the amount of variation in the input voltage $V_{IN}$.

Figure 8:
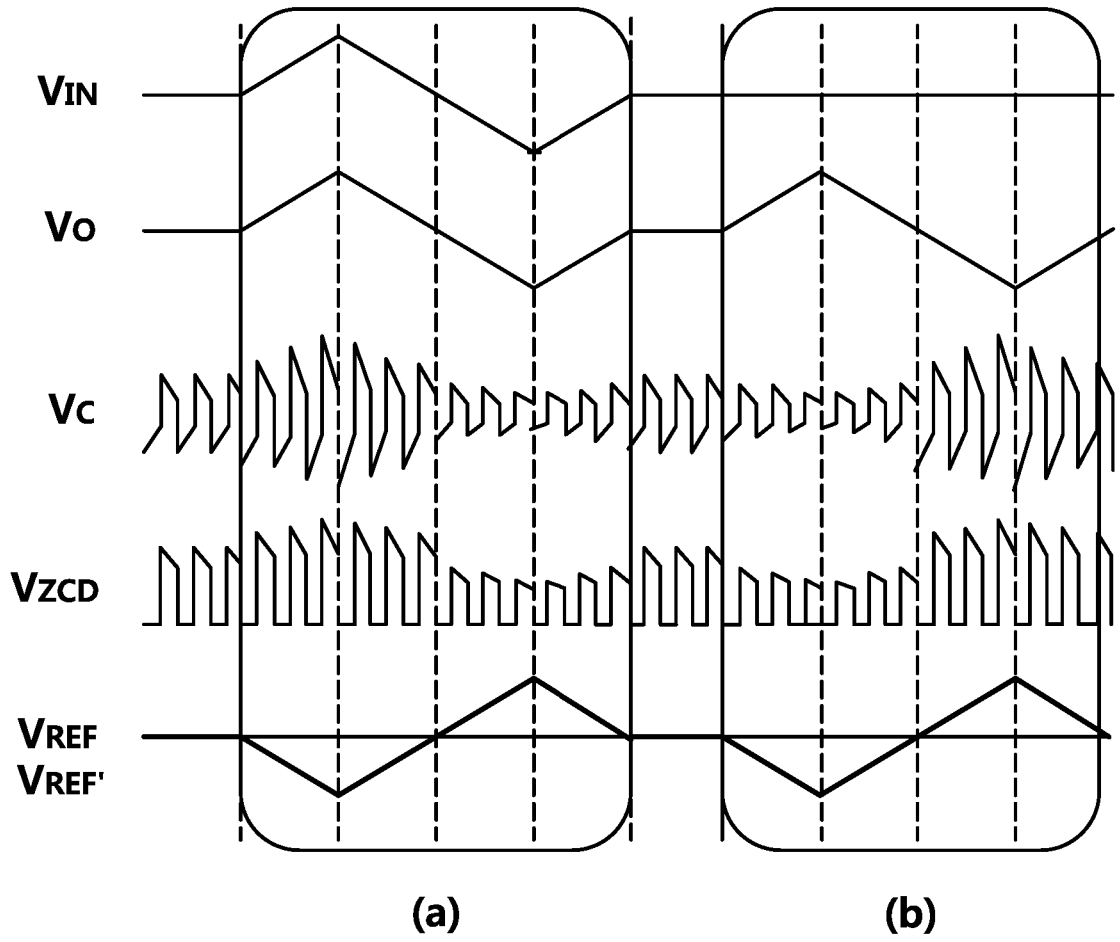
FIG. 8 illustrates a reference voltage regulated according to an input voltage and divided voltage variation applied to a compensation circuit according to an example.

Additionally, the following description provides for a switching drive method as illustrated in the example of FIG. 8 to solve the problem presented, as illustrated, in the example of FIG. 3. According to the example of FIG. 8, when the output voltage $V_O$ varies, the waveforms of the capacitor voltage $V_C$ and the divided voltage $V_{ZCD}$ may also vary.

When the set value of the reference voltage $V_{REF}$ is varied according to the amount of variation in the sensing voltage $V_{CS}$, the driving current $I_D$ may be prevented from being varied. However, unlike the example of FIG. 1, in such an example, the reference voltage $V_{REF}$ may be varied based on the divided voltage $V_{ZCD}$ of the voltage divider 500.

If the amount of variation in the sensing voltage $V_{CS}$ is measurable, it may be possible to vary the set value of the reference voltage $V_{REF}$ in accordance with the amount of variation in the sensing voltage $V_{CS}$. As a result, the driving current $I_D$ may be prevented from being varied.

However, it may be difficult to accurately measure the amount of variation in the sensing voltage $V_{CS}$. Therefore, it may be preferable to measure the amount of variation of the input voltage $V_{IN}$ and the divided voltage $V_{ZCD}$, which are relatively easy to measure, and to vary the set value of the reference voltage $V_{REF}$ based on the amount of variation of the input voltage $V_{IN}$ and the divided voltage $V_{ZCD}$, measured as discussed, above.

The divided voltage $V_{ZCD}$ may be appropriately reduced in magnitude through using the voltage divider 500. The divided voltage $V_{ZCD}$ is also electrically related to the output voltage $V_O$. That is, when measuring the divided voltage $V_{ZCD}$ instead of the output voltage $V_O$, the compensation circuit 450 that does not include the second conversion block 470 may be designed, accordingly.

Specifically, when the reference voltage $V_{REF}$ is reduced by the increase amount of the sensing voltage $V_{CS}$ due to the increase in the input voltage $V_{IN}$ and the divided voltage $V_{ZCD}$, the driving current $I_D$ may be prevented from increasing, in such an example. By contrast, if the reference voltage $V_{REF}$ is increased by the amount of decrease in the sensing voltage $V_{CS}$ due to the decrease in the input voltage $V_{IN}$ and the divided voltage $V_{ZCD}$, the driving current $I_D$ may be prevented from decreasing as well. Accordingly, the compensation circuit 450 may operate the light emitting device 110 at a desired brightness, by controlling the driving current $I_D$ flowing through the light emitting device 110 in this described manner. For example, FIG. 8 illustrates a reference voltage regulated according to variation of an input voltage $V_{IN}$ and divided voltage $V_{ZCD}$ applied to the compensation circuit according to the example of FIGS. 6-7.

However, in the example of FIG. 8, the capacitor voltage $V_C$ and the divided voltage $V_{ZCD}$ may be periodically varied by the switching of the switch 200. Therefore, subsequently, the "divided voltage $V_{ZCD}$" may refer to a sine waveform, in which an average point or a peak of the divided voltage $V_{ZCD}$ of FIG. 8 is connected.

FIG. 8, at (a), illustrates a signal in which an input voltage $V_{IN}$ and divided voltage $V_{ZCD}$ are varied simultaneously. In general, a divided voltage $V_{ZCD}$ may vary as an input voltage $V_{IN}$ varies.

FIG. 8, at (b), illustrates a signal in which the input voltage $V_{IN}$ is kept constant but the divided voltage $V_{ZCD}$ may vary due to other factors. The other factors may include an example in which resistance values of devices may vary due to dispersion occurring during a semiconductor manufacturing process.

According to FIG. 8, at (a), the existing reference voltage $V_{REF}$ may be outputted as a modified reference voltage $V_{REF}'$ in a direction opposite to that of the input voltage $V_{IN}$. Because the divided voltage $V_{ZCD}$ may vary with the input voltage $V_{IN}$, in this example, it may be preferable for the reference voltage $V_{REF}$ to output the modified reference voltage $V_{REF}'$ based on the input voltage $V_{IN}$, instead of the divided voltage $V_{ZCD}$.

Specifically, when the input voltage $V_{IN}$ and the divided voltage $V_{ZCD}$ simultaneously increase, the compensation circuit 450 may regulate the reference voltage $V_{REF}$ to have a low value, based on the increase amount of the input voltage $V_{IN}$. By contrast, when the input voltage $V_{IN}$ and the divided voltage $V_{ZCD}$ simultaneously decrease, the compensation circuit 450 may regulate the reference voltage $V_{REF}$ to have a high value, based on the decrease amount of the input voltage $V_{IN}$.

According to FIG. 8, at (b), when the input voltage $V_{IN}$ remains constant but the divided voltage $V_{ZCD}$ decreases, the compensation circuit 450 may regulate the reference voltage $V_{REF}$ to have a low value, based on the decrease amount of the divided voltage $V_{ZCD}$. By contrast, when the input voltage $V_{IN}$ is kept constant but the divided voltage $V_{ZCD}$ increases, the compensation circuit 450 may regulates the reference voltage $V_{REF}$ to have a high value, based on the increase amount of the divided voltage $V_{ZCD}$.

Subsequently, in the switching driving circuits according to the examples of FIG. 1 and FIG. 6, an example in which a switch 200 may be implemented as a MOSFET is described in further detail.

When a switch 200 is implemented as a MOSFET, a switching control signal may be transmitted to a gate of the MOSFET through a gate terminal, thereby controlling an inductor current $I_L$. That is, when the switching control signal corresponds to a positive value, such as a high level or 1, the switch 200 may be turned on, and when the switching control signal corresponds to a negative value, such as a low level or 0, the switch 200 may be turned off. In this way, the controller 400 may regulate the current supplied to a target circuit 100 in order to regulate the brightness of the light emitting device 110 included in the target circuit 100.

The controller 400 may be connected to the gate terminal of the MOSFET, the target circuit 100 may be connected to the drain terminal, and the sensing resistor 300 may be connected to the source terminal.

When the sensing voltage $V_{CS}$ applied to the sensing resistor 300 and the preset reference voltage $V_{REF}$ are substantially identical to each other, the controller 400 may transmit a switching control signal into the gate terminal of the MOSFET in order to turn off the switch 200.

The drain terminal may be connected to the voltage divider 500, as well as the target circuit 100. The voltage divider 500 may include a capacitor 510, a first divider resistor 520, and a second divider resistor 530 that are connected in series, and may electrically connect a voltage divider terminal 441 between the first and second divider resistors 520 and 530. In this example, the voltage measured between the capacitor 510 and the first divider resistor 520 may be referred to as a capacitor voltage $V_C$.

The capacitor 510 of the voltage divider 500 may block the inductor current $I_L$ from flowing into the first and second divider resistors 520 and 530. This blockage may occur because the driving current $I_D$ flowing through the light emitting device 110 may be accurately controlled by the switch 200 when all of the inductor current $I_L$ flows through the switch 200 into the sensing resistor 300.

In particular, the capacitor 510 of the voltage divider 500 may block the DC current, and may prevent the current from flowing into the voltage divider 500, regardless of the turn-on or turn-off state of the MOSFET. If the capacitor 510 of the voltage divider 500 does not exist, a part of the inductor current $I_L$ may flow into the voltage divider 500 at the drain point of the MOSFET. Accordingly, an example may occur in which the divided voltage $V_{ZCD}$ is not lower than the reference divided voltage $V_{REF_ZCD}$, such that the MOSFET is not turned on. In addition, if the current flows into the voltage divider, it may be difficult to measure the accurate sensing voltage $V_{cs}$, such that it may be difficult to control the constant current. For this reason, an example may provide that the capacitor 510 is included in the introduction of the voltage divider 500.

Figure 9:
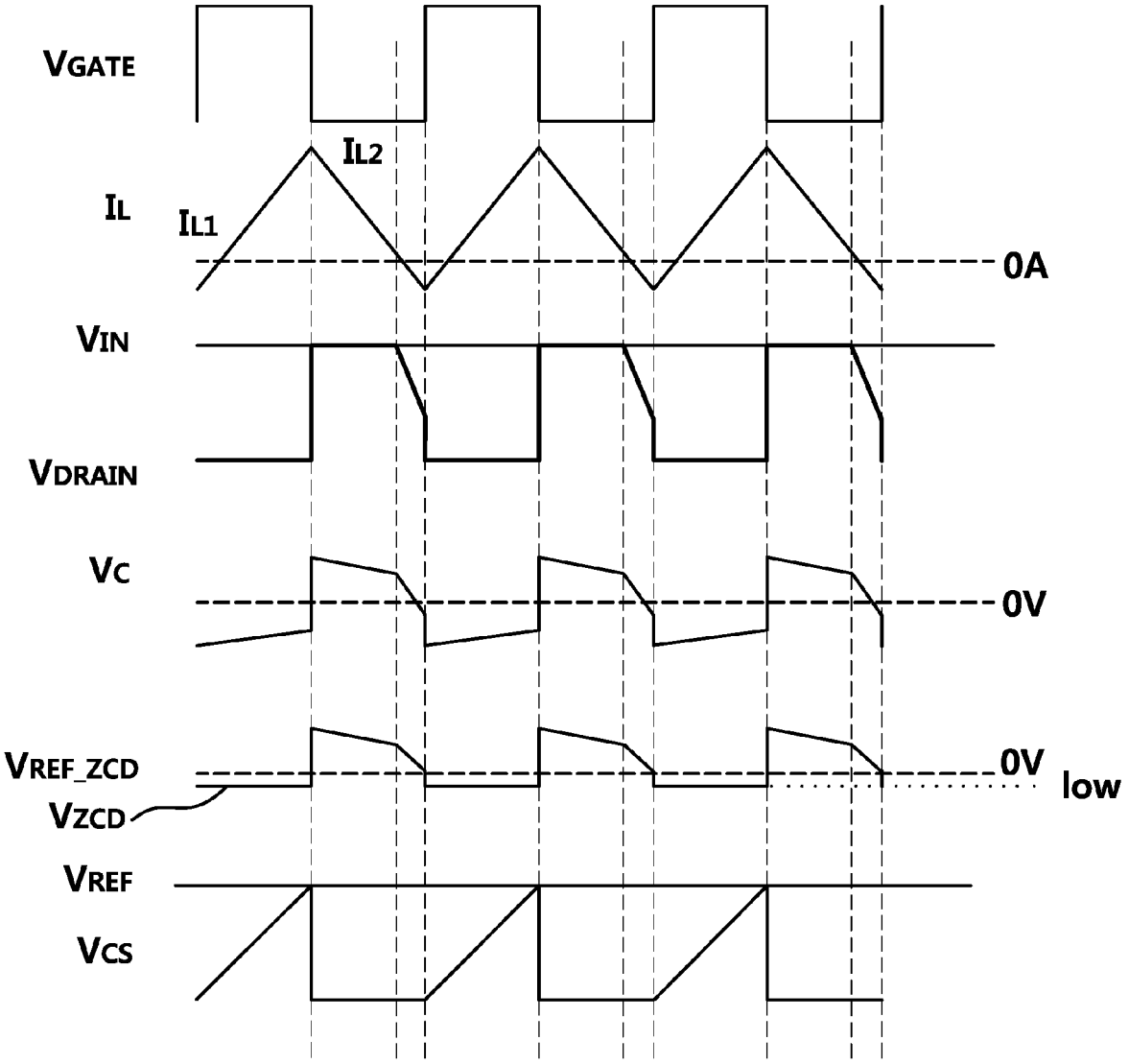
FIG. 9 is a timing diagram of each signal generated in a voltage divider.

FIG. 9 is a timing diagram of respective signals generated in the voltage divider.

According to the example of FIG. 9, even when the capacitor 510 is included, the divided voltage $V_{ZCD}$ may be reduced when the drain voltage $V_{DRAIN}$ is reduced. In the example of FIG. 9, the rectangular boxes with respect to the passage of time, similarly to those of the other drawings, may be identified by dotted lines. Therefore, even if the set value of the reference voltage $V_{REF}$ is varied based on the divided voltage $V_{ZCD}$, the effect may be same as varying the set value of the reference voltage $V_{REF}$ based on the output voltage $V_O$.

According to the example of FIG. 9, the inductor current $I_L$ may flow in the inductor 130 when the MOSFET is turned on. When the inductor current $I_L$ starts to increase as per $I_{L1}$, the inductor current $I_{L1}$ may flow through the sensing resistor $R_{CS}$, and when the sensing voltage $V_{CS}$ is equal to the reference voltage $V_{REF}$, the voltage of the gate terminal of the MOSFET may be reduced and the MOSFET may be turned off.

According to the example of FIG. 9, when the MOSFET is turned off, the inductor current $I_L$ may start to be reduced as per $I_{L2}$, and when the inductor current $I_L$ is smaller than OA, the voltage of the drain terminal may start to be reduced. When the drain voltage $V_{DRAIN}$ decreases, the capacitor voltage $V_C$ and the divided voltage $V_{ZCD}$ may also decrease. When the divided voltage $V_{ZCD}$ is smaller than the reference divided voltage $V_{REF_ZCD}$, the voltage of the gate terminal may be increased again to turn on the MOSFET.

According to the example of FIG. 9, the capacitor voltage $V_C$ may include a positive peak and a negative peak. The example of FIG. 9 shows that the voltage of the drain terminal may rise from a 0 V voltage level to the input voltage $V_{IN}$ at a positive peak. In addition, the example of FIG. 9 shows that the voltage of the drain terminal may be reduced from the magnitude of the input voltage $V_{IN}$ back to a 0 V voltage level at a negative peak.

According to the example of FIG. 9, the divider voltage $V_{ZCD}$ may refer to a voltage in which the capacitor voltage $V_C$ is divided by the first divider resistor 520 and the second divider resistor 530. However, a parasitic diode 600 may be further included between the voltage divider terminal 441 and the ground terminal 444. When the parasitic diode 600 exists, the divided voltage $V_{ZCD}$ may not go below a value of −0.7 V.

Subsequently, the switching driving method according to another example is described in further detail.

The switching driving method according to the other example may include controlling the switch 200 by comparing the sensing voltage $V_{CS}$ that is applied to the sensing resistor 300 connected to one end of the switch 200 with the preset reference voltage $V_{REF}$, measuring the input voltage $V_{IN}$ and the output voltage $V_O$ of the target circuit 100 connected to the other end of the switch 200, and regulating the reference voltage $V_{REF}$ according to the amount of variation of the input voltage $V_{IN}$ or output voltage $V_O$, and turning off the switch 200 when the sensing voltage $V_{CS}$ and the reference voltage $V_{REF}$ are substantially identical to each other.

The controlling may include comparing the sensing voltage $V_{CS}$ with the reference voltage $V_{REF}$, and outputting a switching control signal which turns off the switch 200 by the controller 400 when the sensing voltage $V_{CS}$ and the reference voltage $V_{REF}$ are substantially identical to each other.

The regulating of the reference voltage may regulate the reference voltage $V_{REF}$ to have a low value, based on the increase amount, when the input voltage $V_{IN}$ and the output voltage $V_O$ increase.

In addition, the regulating of the reference voltage may regulate the reference voltage $V_{REF}$ to have a high value, based on the decrease amount, when the input voltage $V_{IN}$ and the output voltage $V_O$ decrease.

The switching driving circuit and the driving method of such a switching driving circuit, according to the present examples may maintain a constant driving current $I_D$, even when the input voltage $V_{IN}$ or the output voltage $V_O$ varies, by regulating the reference voltage $V_{REF}$ to correspond to the amount of variation of the input voltage $V_{IN}$ or the output voltage $V_O$.

The target circuit 100, light emitting device 110, capacitor 120, inductor 130, diode 140, switch 200, sensing resistor 300, controller 400, voltage divider terminal 441, reference voltage terminal 442, sensing terminal 443, ground terminal 444, switching terminal 445, input terminal 446, output terminal 447, compensation circuit 450, first conversion block 460, second conversion block 470, voltage divider 500, capacitor 510, first divider resistor 520, second divider resistor 530, in FIGS. 1-9 that perform the operations described in this application are implemented by hardware components configured to perform the operations described in this application that are performed by the hardware components. Examples of hardware components that may be used to perform the operations described in this application where appropriate include buffers, transistors, controllers, sensors, generators, drivers, memories, comparators, arithmetic logic units, adders, subtractors, multipliers, dividers, integrators, and any other electronic components configured to perform the operations described in this application.

While this disclosure includes specific examples, it will be apparent after an understanding of the disclosure of this application that various varies in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A switching driving circuit, comprising:
a switch configured to switch a driving current supplied to a target circuit comprising at least one light emitting device;
a sensing resistor connected to the switch;
a controller configured to control the switch by comparing a sensing voltage applied to the sensing resistor with a reference voltage; and
a compensation circuit configured to receive the reference voltage, an input voltage applied to one end of the target circuit, and an output voltage output from the other end of the target circuit connected to the switch, and output a modified reference voltage based on an amount of variation of the input voltage and the output voltage.

2. The switching driving circuit of claim 1, wherein the controller is configured to turn off the switch, in response to the sensing voltage and the reference voltage being substantially identical to each other.

3. The switching driving circuit of claim 1, wherein the compensation circuit is configured to:
regulate the reference voltage to have a lower value than a set value based on an increase amount of the input voltage, in response to the input voltage and the output voltage increasing simultaneously, and
regulate the reference voltage to have a higher value than the set value based on a decrease amount of the input voltage, in response to the input voltage and the output voltage decreasing simultaneously.

4. The switching driving circuit of claim 1, wherein the compensation circuit is configured to:
regulate the reference voltage to have a lower value than a set value based on an increase amount of the output voltage, in response to the input voltage being constant and the output voltage increasing, and
regulate the reference voltage to have a higher value than the set value based on a decrease amount of the output voltage, in response to the input voltage being constant and the output voltage decreasing.

5. The switching driving circuit of claim 1, wherein the compensation circuit comprises:
a first conversion block configured to convert a level of the input voltage; and
a second conversion block configured to convert a level of the output voltage.

6. The switching driving circuit of claim 1, further comprising:
a voltage divider connected to the switch and the controller, and configured to generate a divided voltage based on the output voltage and apply to the controller.

7. The switching driving circuit of claim 6, wherein the voltage divider comprises:
resistors configured to divide a voltage; and
a capacitor connected in series with the resistors.

8. The switching driving circuit of claim 6, wherein the compensation circuit comprises a first conversion block configured to convert a level of the input voltage, and
wherein the output voltage is the divided voltage.

9. The switching driving circuit of claim 8, wherein the compensation circuit is configured to:
regulate the reference voltage to have a lower value than a set value based on an increase amount of the input voltage, in response to the input voltage and the divided voltage increasing simultaneously, and
regulate the reference voltage to have a higher value than the set value based on a decrease amount of the input voltage, in response to the input voltage and the divided voltage decreasing simultaneously.

10. The switching driving circuit of claim 8, wherein the compensation circuit is configured to:
regulate the reference voltage to have a lower value than a set value based on an amount of decrease of the divided voltage, in response to the input voltage being constant and the divided voltage decreasing, and
regulate the reference voltage to have a higher value than the set value based on an amount of increase of the divided voltage, in response to the input voltage being constant and the divided voltage increasing.

11. The switching driving circuit of claim 8, wherein the controller comprises:
an input terminal configured to check the input voltage;
a voltage divider terminal configured to check the divided voltage;
a switching terminal configured to check a switching control signal applied to the switch from the controller;
a sensing terminal configured to check the sensing voltage; and
a reference voltage terminal configured to check the reference voltage.

12. The switching driving circuit of claim 6, wherein the controller comprises at least one comparator configured to compare the sensing voltage and the reference voltage.

13. The switching driving circuit of claim 6, wherein the controller comprises:
an input terminal configured to check the input voltage;
an output terminal configured to check the output voltage;
a voltage divider terminal configured to check the divided voltage;
a switching terminal configured to check a switching control signal applied to the switch from the controller;
a sensing terminal configured to check the sensing voltage; and a reference voltage terminal configured to check the reference voltage.

14. The switching driving circuit of claim 1, wherein the target circuit comprises:

at least one inductor connected in series with the light emitting device, and wherein the switch is configured to switch a current in the at least one inductor.

15. A driving method of a switch comprising a compensation circuit, the method comprising:

controlling the switch configured to switch a driving current supplied to a target circuit comprising at least one light emitting device by comparing a sensing voltage applied to a sensing resistor connected to one end of the switch with a reference voltage;

measuring an input voltage input into one end of the target circuit and an output voltage output from the other end of the target circuit connected to the other end of the switch; and outputting a modified reference voltage by varying the reference voltage based on an amount of variation of the input voltage and the output voltage, wherein the switch is configured to be turned off in response to the sensing voltage and the reference voltage being substantially identical to each other.

16. The method of claim 15, wherein the controlling comprises:

comparing the sensing voltage and the reference voltage; and outputting a switching control signal for turning off the switch, by a controller, in response to the sensing voltage and the reference voltage being substantially identical to each other.

17. The method of claim 15, wherein the varying of the reference voltage regulates the reference voltage to have a lower value than a set value based on an increase amount of the input voltage, in response to the input voltage and the output voltage increasing simultaneously.

18. The method of claim 15, wherein the varying of the reference voltage regulates the reference voltage to have a higher value than a set value based on a decrease amount of the input voltage, in response to the input voltage and the output voltage decreasing simultaneously.

19. The method of claim 15, wherein the varying of the reference voltage regulates the reference voltage to have a lower value than a set value based on an increase amount of the output voltage, in response to the input voltage being constant and the output voltage increasing.

20. The method of claim 15, wherein the varying of the reference voltage regulates the reference voltage to have a higher value than a set value based on a decrease amount of the output voltage, in response to the input voltage being constant and the output voltage decreasing.

21. The method of claim 15, wherein the measuring of the output voltage measures a divided voltage that is generated based on the output voltage by a voltage divider including resistors and capacitors connected in parallel with the switch.

22. The method of claim 21, wherein the varying of the reference voltage regulates the reference voltage to have a lower value than a set value based on an increase amount of the input voltage, in response to the input voltage and the divided voltage simultaneously increasing, and wherein the varying of the reference voltage regulates the reference voltage to have a higher value than the set value based on a decrease amount of the input voltage, in response to the input voltage and the divided voltage decreasing simultaneously.

23. The method of claim 21, wherein the varying of the reference voltage regulates the reference voltage to have a lower value than a set value based on a decrease amount of the divided voltage, in response to the input voltage being constant and the divided voltage decreasing, and wherein the varying of the reference voltage regulates the reference voltage to have a higher value than the set value based on an increase amount of the divided voltage, in response to the input voltage being constant and the divided voltage increasing.

24. A switching driving circuit, comprising:

a switch configured to switch a driving current supplied to a target circuit comprising at least one light emitting device;

a sensing resistor connected to the switch;

a controller configured to control the switch by comparing a sensing voltage applied to the sensing resistor with a reference voltage; and a compensation circuit configured to receive the reference voltage, an input voltage applied to one end of the target circuit, and an output voltage output from the other end of the target circuit connected to the switch, and output a modified reference voltage based on an amount of variation of the output voltage, wherein the switch is configured to be turned off in response to the sensing voltage and the reference voltage being substantially identical to each other.

25. The switching driving circuit of claim 24, wherein the controller comprises at least one comparator configured to compare the sensing voltage and the reference voltage.

26. The switching driving circuit of claim 24, wherein the compensation circuit comprises either one or both of a first conversion block configured to convert a level of the input voltage and a second conversion block configured to convert a level of the output voltage.

27. The switching driving circuit of claim 24, further comprising:

a voltage divider connected to the switch and the controller, and configured to apply a divided voltage to the controller.

* * * * *